US006558030B2

(12) United States Patent
Blusseau et al.

(10) Patent No.: US 6,558,030 B2
(45) Date of Patent: May 6, 2003

(54) ELLIPTICAL HEADLIGHT WITH BEAM MODIFICATION BY MOVEMENT OF OPTICAL ELEMENTS

(75) Inventors: Eric Blusseau, Bobigny (FR); Alexis Dubrovin, Bobigny (FR); Benny Grigorescu, Bobigny (FR); Laurent Jeannot, Bobigny (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 09/898,952

(22) Filed: Jul. 3, 2001

(65) Prior Publication Data

US 2002/0001197 A1 Jan. 3, 2002

(30) Foreign Application Priority Data

Jul. 3, 2000 (FR) ..... 0008605

(51) Int. Cl.[7] ..... F21V 11/00

(52) U.S. Cl. ..... 362/508; 362/523; 362/532; 362/285; 362/372

(58) Field of Search ..... 362/508, 523, 362/532, 538, 285, 372

(56) References Cited

U.S. PATENT DOCUMENTS 4,985,816 A * 1/1991 Seko et al. ..... 362/303
5,911,502 A * 6/1999 Zilgitt et al. ..... 362/508
6,341,886 B1 * 1/2002 Dussans et al. ..... 362/523
6,354,718 B1 * 3/2002 Iwaki et al. ..... 362/351

FOREIGN PATENT DOCUMENTS

FR 1 262 631 9/1961
FR 2 773 604 7/1999

OTHER PUBLICATIONS

French Search Report dated Oct. 25, 2000.

Patent Abstracts of Japan vol. 015, No. 235 (M–1125) Jun. 17, 1991 and JP 03 074001 A (Koito Mfg Co Ltd), Mar. 28, 1991.

* cited by examiner

*Primary Examiner*—Sandra O'Shea
*Assistant Examiner*—Ronald E. Delgizzi
(74) *Attorney, Agent, or Firm*—Morgan & Finnegan LLP

(57) ABSTRACT

A motor vehicle headlight has a reflector with two focal regions, a light source in one of these focal regions producing a pool of reflected light in the other focal region, and a lens which converts the pool of light into a beam projected on the road. The headlight includes means for displacing the light source with respect to the reflector.

10 Claims, 5 Drawing Sheets

ELLIPTICAL HEADLIGHT WITH BEAM MODIFICATION BY MOVEMENT OF OPTICAL ELEMENTS

FIELD OF THE INVENTION

This invention relates to headlights of the elliptical type for motor vehicles.

BACKGROUND OF THE INVENTION

A headlight of the elliptical type consists generally of a reflector having a first focal zone, with a light source placed in the vicinity of the first focal zone, together with a second focal zone. The light from the light source, after being reflected by the reflector, is concentrated in the vicinity of the second focal zone. A lens, which is typically a spherical planar-convex lens, is focussed in the vicinity of the second focal zone and projects the concentrated radiation as a beam on the ground in front of the vehicle, that is to say on the road in normal operation.

It is also conventional to provide in the second focal zone a screen for masking part of the radiation. An upper edge of this screen defines a cut-off line in the formed beam, so that the beam becomes a cut-off or dipped beam, and especially a dipped passing beam.

Although these headlights are very compact, they are particularly sensitive to errors in the positioning of the various optical elements of the headlights themselves. For this reason, modification of the beam by displacement of one of the optical elements is not usually recommended. However, it has been proposed in U. S. Pat. No. 5,707,129, to provide an elliptical headlight in which the reflector and the lamp constitute an assembly which is movable with respect to the lens, this assembly being displaced according to the curvature of a curve in the road, so that it produces a turning beam, that is to say illumination which is adapted to the curve around which the vehicle is travelling.

However, the relative movement of the reflector and lens causes major changes to take place in the optical behaviour of the headlight. These changes are not capable of being easily controlled. In the above mentioned United States patent, it is recommended (and it is in fact necessary) that a masking screen be provided which is movable independently of the assembly consisting of the reflector and the lamp (light source), in order to provide the best possible correction to these optical modifications in the course of the movement.

DISCUSSION OF THE INVENTION

An object of the invention is to overcome the above mentioned disadvantages, by proposing a headlight of the elliptical type having elements that are movable in order to modify the form of the illuminating beam, while being of less sophisticated construction and giving a beam which is optically defined in the best way.

According to the invention, a headlight for a motor vehicle comprising a light source, a reflector with two focal regions, and a lens, the source being located in one of the two focal regions in such a way as to produce a pool of reflected light in the other focal region, and the lens being arranged to convert this pool into a beam projected on the road, is characterised in that the headlight further includes means for selectively moving (displacing) the source with respect to the reflector.

The invention leads to the surprising result that a small displacement of the light source enables various beam configurations to be obtained. These configurations are for example: (a) a dipped passing beam of the type known to be best for town driving; or (b) a dipped passing beam adapted so that it is particularly suited to driving on a trunk road (variously referred to as a motorway, thruway or autoroute, for example); or (c) a dipped turning beam, as discussed above; or (d) a beam which is adapted to prevent drivers travelling in the opposite direction from being dazzled by the effects of mud on the headlight, which causes scattering of the light beam.

According to various preferred but optional features which may be taken singly or in any practical combination:

- the means for displacing the source (such as a lamp) with respect to the reflector comprise a lamp base or lamp holder, and means for holding the said base while enabling the latter to be displaced within the headlight;
- the means for selectively displacing the source with respect to the reflector are arranged to shift the lamp through one or a few millimeters horizontally towards one side of the reflector;
- the means for selectively displacing the source with respect to the reflector are arranged to permit such relative movement in a vertical direction;
- the headlight includes means for driving the source with respect to the reflector into two distinct positions, one of which corresponds to a first dipped passing beam having a first zone of concentration of light intensity which is substantially centred in front of the vehicle, while the other said position corresponds to a dipped passing beam having a second zone of concentration of light intensity which is offset substantially horizontally towards one side with respect to the concentration zone of the first dipped beam;
- the headlight includes means for driving the source into two distinct positions, one of which corresponds to a first dipped passing beam having a first zone of concentration of light intensity which is substantially centred in front of the vehicle, while the other said position corresponds to a dipped passing beam having a second zone of concentration of light intensity which is offset to the left of the concentration zone of the first dipped beam;
- the means for selectively displacing the source with respect to the reflector are arranged to give three relative positions of the source and reflector, which are distinct and which correspond to three distinct dipped passing beams, namely a first beam with a centred light concentration zone, and two further beams, each having a light concentration zone offset in a direction which is different with respect to the concentration zone of the first beam;
- the headlight includes means for displacing the light source, on command, by one or more millimeters with respect to the reflector in a leftward or rightward or downward direction with respect to the direction of propagation of the light;
- the means for displacing the source with respect to the reflector are arranged to displace the source selectively in each of the directions consisting of leftward, rightward and downward;
- the means for selectively displacing the source with respect to the reflector are arranged to produce, on command, relative displacement such as to provide selectively a left or right offset of the source, the value of which is so chosen as to give a dipped turning beam, on the left or right respectively.

Further features and advantages of the invention will appear on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
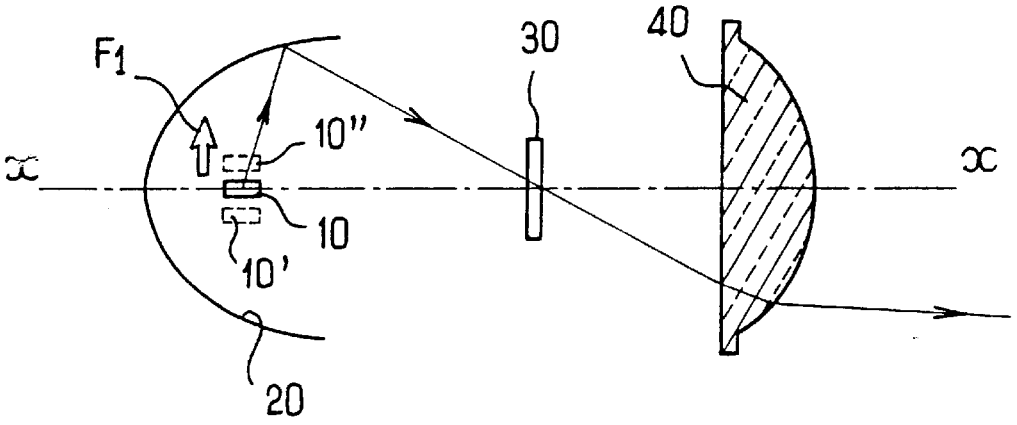
FIG. 1 is a diagrammatic view in horizontal cross section of a headlight of the elliptical type for a dipped passing beam, in accordance with the invention.

With reference to FIG. 1, the elliptical type headlight for a dipped beam, shown therein, comprises a light source 10 such as a filament of an incandescent lamp or the light-emitting arc of a gas discharge lamp. This light source cooperates with a reflector 20 of the elliptical type, to produce a pool, or patch, of light in a zone of concentration which is situated in the vicinity of the optical axis x—x of the reflector and in front of the latter.

This pool of light is partly occulted, or masked, by an opaque shade or screen 30 situated in the said concentration zone, and a planar-convex lens 40 projects the light patch, partially screened by the screen 30, towards the road.

It will be noted here that the reflector 20 may be a pure ellipsoid of revolution, or more generally it may adopt any geometry suitable for producing the desired patch of light in the concentration zone. In this example, the reflector 20 is made in accordance with the detailed description given in French published patent application No. FR 2 773 604.

However, the arrangements which will be described below are easily effected in elliptical headlights of current types, by making a few adaptations which will readily occur to the person having normal skill in this technical field. These adaptations involve simple adjustments in the light of the present description. By way of additional example, it will be possible to make use of the arrangements to be described below in the context of another elliptical headlight of well known type, for example the one which is described in French patent publication No. FR 2 704 044.

Figure 2:
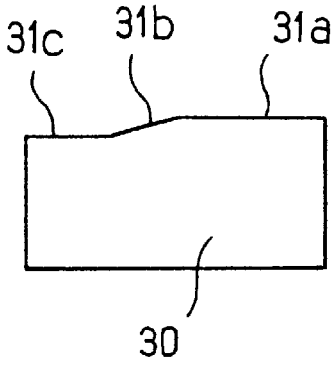
FIG. 2 is a front view of a masking screen of the same headlight.

The profile of the upper edge of the screen 30 is shown in FIG. 2, with three straight segments 31, 31*b* and 31*c*, the middle one of which is inclined at about 15° so as to raise the cut-off line in the manner known per se. In another version a simple V-shape may be provided, with a horizontal segment adjacent to an oblique segment, or again, a Z-shaped cut-off line such as that which is used in the United States.

Figure 3:
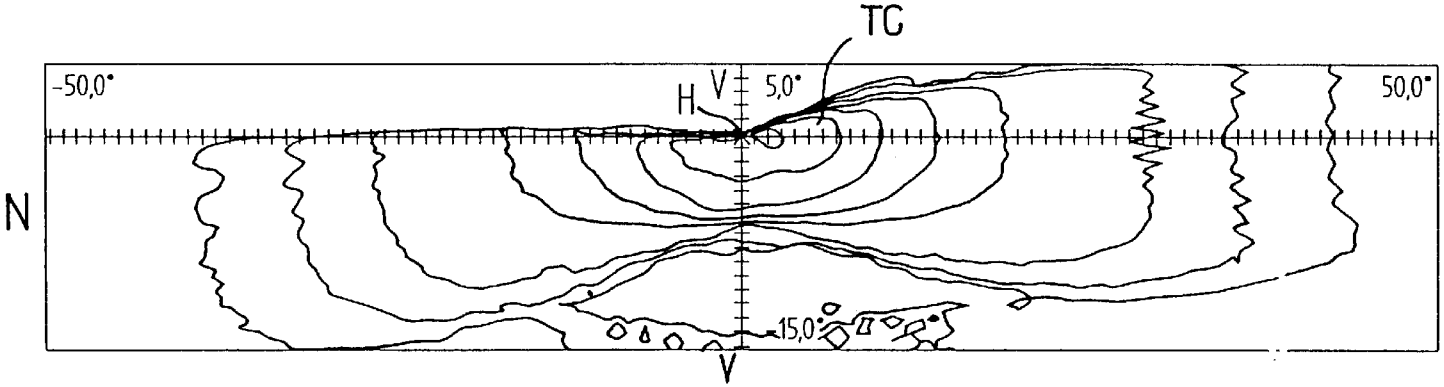
FIG. 3 shows, by means of a set of isolux curves, the appearance of the beam produced by the headlight of FIG. 1 with the source in a centred position.

The appearance of the dipped passing beam which is obtained by such a headlight, with the filament in a position on the first focal zone of the reflector 20, is shown in FIG. 3, to which reference is now made. It will be noted that the reflector 20 in this case is so designed that the area of maximum concentration, TC, in the beam, is offset slightly towards the right with respect to the median vertical reference axis v—v, so as to give good low level illumination of the side of the road (on the right hand side in this example). It will also be noted that the profile of the cut-off line corresponds to the shape of the upper edge of the mask 30.

In this case, the lamp 10 is mounted on a base which is movable in the base hole of the reflector. More precisely, a base is chosen which is mounted so as to be free in rotation on two axes of rotation which are transverse to each other and transverse to the axis x—x. Such a fastening, with rotational mobility, is easily obained, for example by fixing the rear of the base on an element which defines a ball mounting. The rotary movement about each of these two axes is for example obtained using two electric motors.

The lamp 10 can thus be selectively moved sideways, that is to say substantially horizontally and at right angles to the optical axis x—x (as indicated by the arrow F1 in FIG. 1). In this way, a first offset position of the lamp 10 is obtained. In this position, indicated in FIG. 1 in broken lines at 10' , the filament is 2 mm to the right of the base position.

Figure 4:
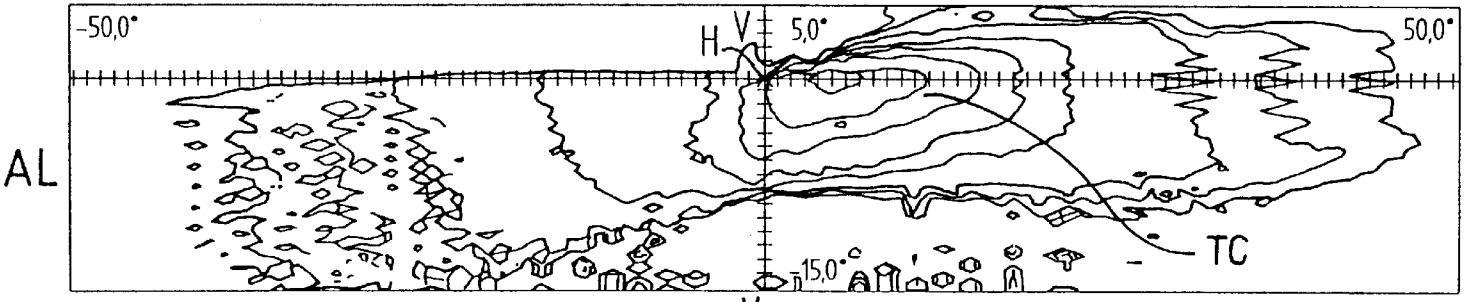
FIG. 4 shows, by means of a set of isolux curves, the appearance of a dipped beam which is modified in order to avoid dazzling effects caused by splashing with mud, the beam being produced by the same headlight as FIG. 1 but with the source in a first offset position.

In this position of the source, it will be clear that the concentration zone TC of the projected beam remains intact and is offset to the right. This situation is illustrated in FIG. 4, to which reference is now made and in which it will be noticed that the amount of light is reinforced towards the top, and towards a reference point H corresponding to the axis of the road. In addition, the zone which is situated in the left half of the beam is reduced in intensity. Such a modified beam accordingly reduces the danger of dazzling of the drivers of vehicles travelling in the opposite direction in muddy driving conditions.

The illumination thus obtained is particularly suitable when the road is muddy, because an effective form of beam is preserved while the concentration of light is lowered into a specific zone which corresponds exactly to the part of the light which is usually reflected by the road towards the eyes of the driver travelling in the opposite direction.

The amplitude of the offset of the lamp 10 may vary according to the reflector and lens used, but the preferred present modification will be used typically for an offset of the filament of about 2 mm towards the right.

Thus, a traditional dipped passing beam headlight of the elliptical kind can, using simple, inexpensive and reliable means, be converted into a headlight with two functions which, by controlling an actuating motor from the fascia of the vehicle, enables either a conventional dipped passing beam to be produced, or enables a modified dipped passing beam to be produced for travelling in muddy conditions.

Now, and still with reference to FIG. 1, a second position 10" of the lamp 10 is shown, in which this time it is offset laterally towards the left of the axis x—x. In this case, the sideways offset is through one millimeter. In this new position 10" the light concentration zone TC is offset, in this case towards the left as seen from behind. This arrangement is shown in FIG. 5.

Figure 5:
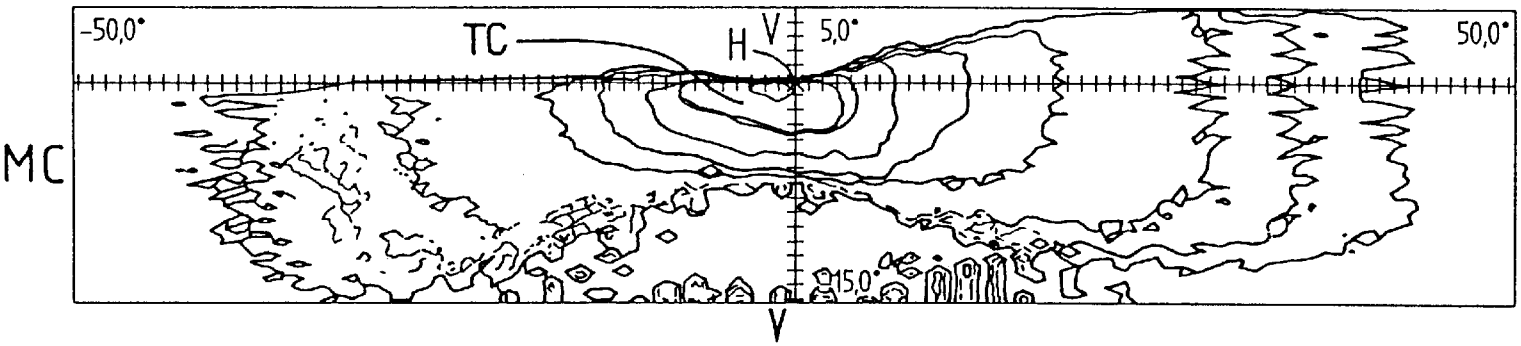
FIG. 5 shows, by means of a set of isolux curves, the appearance of a dipped beam which is specifically appropriate for motorway driving, the beam being obtained with the same headlight as in FIG. 1 but with the source in a second offset position.
Figure 6:
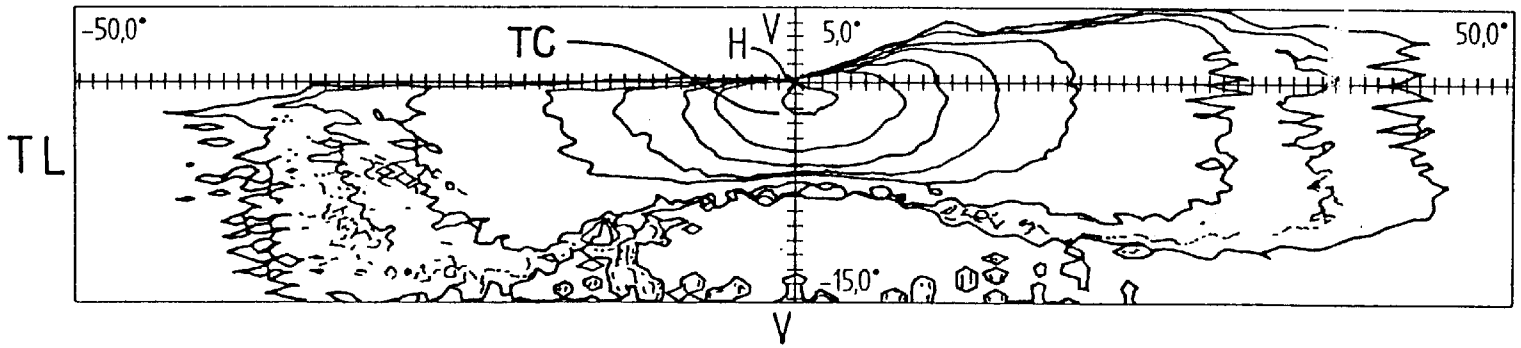
FIG. 6 shows, by a set of isolux curves, the appearance of a dipped beam which is modified to be particularly suitable for town driving, the beam being produced by the same headlight as in FIG. 1 but with the source in a third offset position.

With reference to FIG. 5, the light is slightly enhanced in the left hand half in the vicinity of the vertical central axis v—v, the effect of which is to increase the quantity of light along the axis of the road and to contribute to the visual comfort of the driver, in particular on motorways where the transverse distance between drivers travelling in opposite directions is greater. Finally, the offset of the lamp 10 may (in accordance with a feature of the present invention) be made vertical in direction. This gives the particularly surprising effect that it enables a beam to be obtained which is found to be of specific advantage for driving in towns. Thus, by offsetting the filament by 0.5 mm downwards, and with reference to FIG. 6, a beam is obtained having an upper limit which is lower in its right half, though it is hardly modified at all in the left zone, and it is neither attenuated nor displaced in the central zone of high concentration.

The beam which is obtained by simple downward offset through a distance which will be determined according to the reflector being used, but which is typically 0.5 mm, accordingly calls, as an essential modification, for attenuation of intensity in a zone which is limited to the upper right zone. This is of particular advantage in a town in order to avoid dazzling of people on the side of the street.

Figure 7:
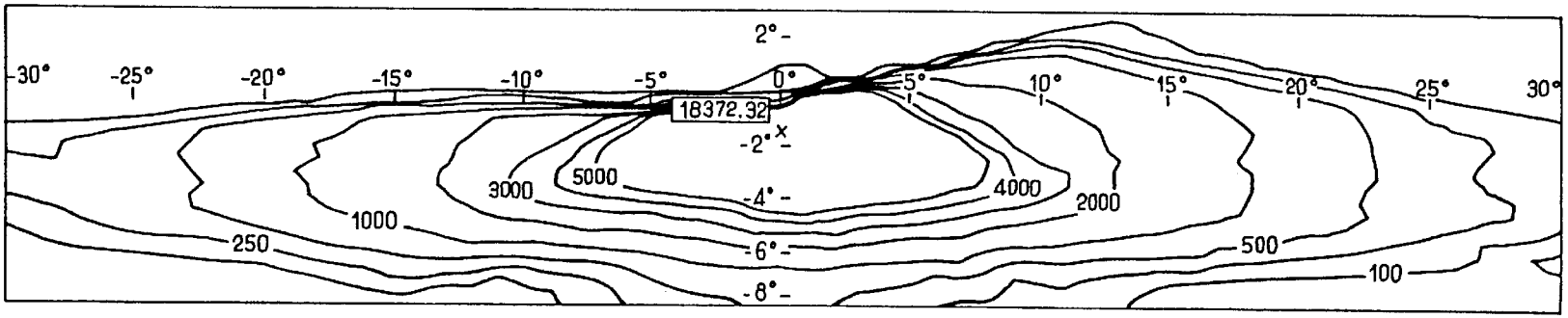
FIG. 7 is a second isolux representation of the beam which is obtained with a centred source in a conventional elliptical headlight.
Figure 8:
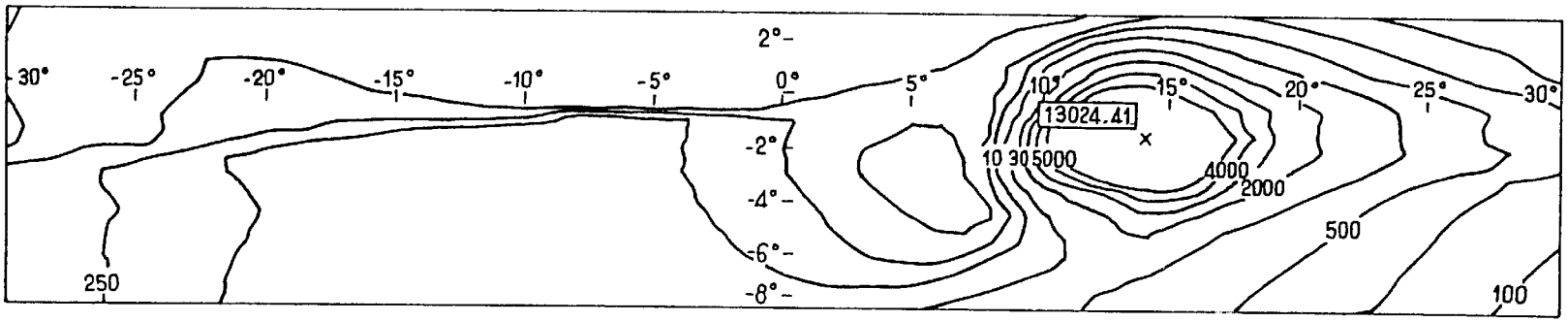
FIG. 8 is an isolux representation of a right dipped turning beam which is obtained by displacement of the source in the same headlight as in FIG. 7.
Figure 9:
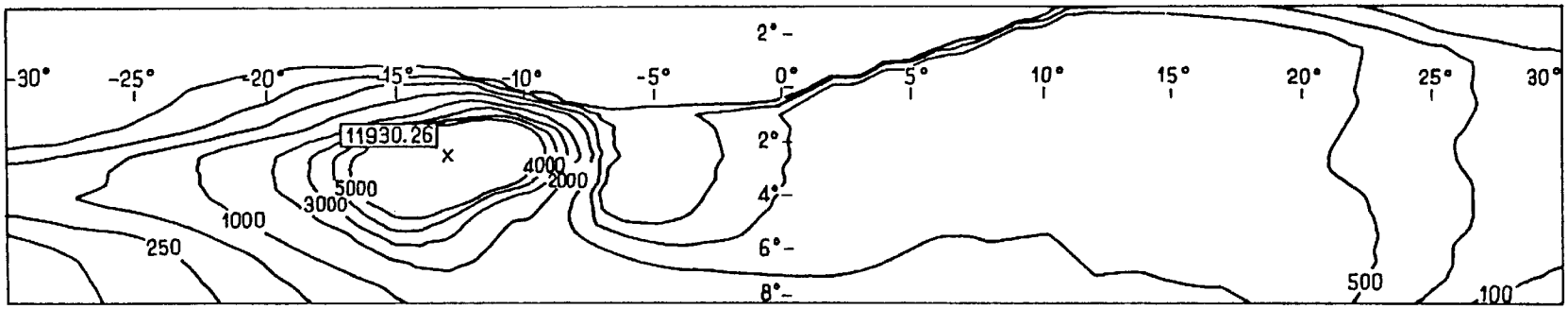
FIG. 9 is an isolux representation of a left dipped turning beam obtained by displacement of the source in the same headlight.

Reference is now made to FIGS. 7 to 9. FIG. 7 shows a prior art arrangement, and as shown in FIGS. 8 and 9, by comparison with FIG. 7, an offset of the filament such that the latter is further forward on one side of the reflector, from the base position of the filament, also enables an offset of the beam to be easily obtained through an angle which may reach 150 towards the side (that is to say 30% using the definition which is conventional in this field).

By inclining a lamp 10 a few centimeters long from a vertical geometric axis of rotation, in this example through an angle of 15°, an offset of the beam of 15° to the right is obtained as shown in FIG. 8, or the same offset towards the left as shown in FIG. 9, according to the side towards which the lamp is inclined. In another version, this displacement of the lamp may not be by inclining it but by movement in translation. The rotational offset by 15° corresponds in practice to a lateral displacement of the filament of several millimeters, and this is valid with a few adjustments for all conventional elliptical reflectors.

The invention is applicable not only to a dedicated dipped beam headlight, in which the screen 30 normally occupies a fixed position, but also in a headlight with both a dipped beam function and a main beam function, in which the screen 30 can be retracted so that it no longer masks the pool of light.

In addition, a person skilled in this technical field will be able to carry out the necessary transpositions in the case of headlights designed for driving on the left.

What is claimed is:

1. A motor vehicle headlight comprising a reflector defining two focal regions, a light source placed in one said region to produce a pool of reflected light in the other said focal region, and a lens disposed in front of the reflector and arranged to convert the said pool of light into a beam for projection on the ground in front of the vehicle, the headlight further including displacement means connected to the light source for selectively displacing the light source with respect to the reflector into different positions, wherein the headlight produces a dipped beam in each position.

2. A headlight according to claim 1, further comprising a lamp base holding the said light source, and holding means connected to the lamp base for holding the lamp base and for displacing the lamp base in the headlight, the said displacement means comprising the lamp base and holding means.

3. A headlight according to claim 1, wherein the said displacement means are arranged to shift the said source through at least one millimeter horizontally towards one side of the reflector.

4. A headlight according to claim 1, wherein the said displacement means are arranged to displace the source vertically.

5. A headlight according to claim 1, wherein the said displacement means define two distinct positions of the light source with respect to the reflector, the displacement means being adapted to drive the light source selectively into the said two positions, the said positions comprising a first position corresponding to a first dipped passing beam defining a light intensity concentration zone substantially centred in front of the vehicle, and a second position corresponding to a dipped passing beam defining a second light intensity concentration zone which is offset substantially horizontally to one side with respect to the first concentration zone.

6. A headlight according to claim 1, wherein the said displacement means define two distinct positions of the light source, the displacement means being adapted to drive the light source selectively into the said two positions, the said positions comprising a first position corresponding to a first dipped passing beam defining a light intensity concentration zone substantially centred in front of the vehicle, and a second position corresponding to a dipped passing beam defining a second light intensity concentration zone which is offset to the left of the first concentration zone.

7. A headlight according to claim 1, wherein the said displacement means define three positions of the source from the reflector which are distinct from each other and in which the headlight defines three distinct dipped passing beams, namely a first beam with a centred light concentration zone, and a second beam and a third beam, each of said second and third beams defining a light concentration zone offset in a different direction with respect to the concentration zone of the first beam.

8. A headlight according to claim 1, wherein the said displacement means comprise means for shifting the light source on command by at least one millimeter with respect to the reflector in a direction selected from the group consisting of a leftward direction, a rightward direction, and a downward direction with respect to the direction of propagation of the light.

9. A headlight according to claim 8, wherein the said means for shifting the light source with respect to the reflector are arranged to shift the source selectively into each of the directions in the said group.

10. A headlight according to claim 1, wherein the said displacement means are arranged to produce, on command, relative displacement such as to shift the source selectively to the left and the right by an amount such as to give a left dipped turning beam and a right dipped turning beam respectively.

* * * * *